US006480114B2

(12) United States Patent
Estelle

(10) Patent No.: US 6,480,114 B2
(45) Date of Patent: Nov. 12, 2002

(54) HIGH IMPEDANCE DIAGNOSTIC FOR GUN DRIVER AND METHOD

(75) Inventor: Peter W. Estelle, Norcross, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 09/998,877

(22) Filed: Oct. 31, 2001

(65) Prior Publication Data

US 2002/0134792 A1 Sep. 26, 2002

Related U.S. Application Data

(60) Provisional application No. 60/278,227, filed on Mar. 23, 2001.

(51) Int. Cl.[7] ..... G08B 21/00

(52) U.S. Cl. ..... 340/662; 340/588; 340/595; 340/691.3; 340/815.65; 340/679; 340/584; 340/664; 340/332; 374/152

(58) Field of Search ..... 340/662, 588, 340/595, 691.3, 815.65, 679, 584, 664, 332; 374/152

(56) References Cited

U.S. PATENT DOCUMENTS 4,967,935 A * 11/1990 Celest ..... 222/63
6,296,811 B1 * 10/2001 Sasaki ..... 422/100
6,380,861 B2 * 4/2002 Estelle et al. ..... 340/588

* cited by examiner

*Primary Examiner*—Jeffery Hofsass
*Assistant Examiner*—Tai T. Nguyen
(74) *Attorney, Agent, or Firm*—Wood, Herron & Evans, L.L.P.

(57) ABSTRACT

An apparatus for detecting a high impedance load on an output of a driver circuit having a power switching circuit providing output signals to a coil. Each output signal results from a drive signal that has a waveform comprising a higher magnitude initial peak period followed by a lower magnitude hold period. The driver circuit has a feedback circuit providing a difference signal as a function of a difference between an output signal and a corresponding drive signal. A diagnostic circuit connected to the driver circuit provides a high impedance error signal in response to detecting the difference signal crossing a threshold magnitude during a higher magnitude initial peak period of a drive signal.

25 Claims, 6 Drawing Sheets

HIGH IMPEDANCE DIAGNOSTIC FOR GUN DRIVER AND METHOD

This application claims the benefit of U.S. Provisional Application No. 60/278,227 entitled "HIGH IMPEDANCE DIAGNOSTIC FOR GUN DRIVER AND METHOD", filed on Mar. 23, 2001.

FIELD OF THE INVENTION

The present invention generally relates to an apparatus and method for dispensing fluids and more specifically, to a gun driver diagnostic circuit for a fluid dispensing apparatus.

BACKGROUND OF THE INVENTION

Pneumatic and electric fluid dispensers have been developed for dispensing applications requiring a precise placement of a fluid. Pneumatic dispensers have a significant advantage in that the pneumatic solenoid operating the dispensing valve provides a sufficient force so that the dispensing valve operation is essentially independent of the viscosity of the fluid being dispensed. However, pneumatic solenoids have disadvantages in that they often have a shorter life than electric solenoids, and the operation of the pneumatic solenoid is subject to less precise control than the electric solenoid in an electric fluid dispenser. Therefore, in some applications, electrically operated fluid dispensers are preferred over pneumatic fluid dispensers.

Generally, electrically operated fluid dispensers include an electromagnetic coil surrounding an armature that is energized to produce an electromagnetic field with respect to a magnetic pole. The electromagnetic field is selectively controlled to open and close a dispensing valve by moving a valve stem connected to the armature. More specifically, the forces of magnetic attraction between the armature and the magnetic pole move the armature and valve stem toward the pole, thereby opening the dispensing valve. At the end of a dispensing cycle, the electromagnet is de-energized, and a return spring returns the armature and valve stem to their original positions, thereby closing the dispensing valve.

With both pneumatic and electric dispensing guns, a driver circuit provides a drive signal to an inductive load, either a solenoid coil in a pneumatic gun or a gun-operating coil in an electric gun. Changing electrical characteristics of the load or output circuit connected to the driver circuit can result in inconsistent and improper operation of the coil being driven by the driver circuit and hence, the operation of the fluid dispensing gun is adversely affected.

For example, the output circuit may be improperly wired or, wires may be damaged and broken such that an open circuit or high resistance load is connected on the driver circuit. With such an open circuit condition, the dispensing gun fails to operate. Such a failure may occur any time that the dispensing gun is being commanded to operate and may go unnoticed by the user until defective or scrap product is observed. Thus, it is useful to be able to detect such a high impedance or open circuit condition and signal the user, so that corrective action can be taken.

In other situations, the driver circuit may be connected to a dispensing gun with a coil having an impedance that is mismatched to the output impedance of the driver circuit. While some impedance mismatching is acceptable, excessive impedance mismatching can result in an inconsistent operation of the fluid dispensing gun.

Consequently, there is a need for a diagnostic circuit for use with a driver circuit of a fluid dispensing gun that detects and alerts a user to higher output circuit impedances that can adversely effect the operation of the fluid dispensing gun.

SUMMARY OF THE INVENTION

The present invention provides a simple and reliable diagnostic circuit for a driver output circuit of a fluid dispensing gun that is sensitive to a wide range of high impedance conditions. The diagnostic circuit of the present invention is capable of signaling the user of high impedance characteristics in the driver output circuit that may result in an inconsistent operation of the fluid dispensing gun. The diagnostic circuit of the present invention also signals the user in the event the user attempts to use a dispensing gun presenting a severe impedance mismatch with the output of the driver circuit. The diagnostic circuit of the present invention is especially useful in providing signals, in a timely manner, that apprise the user of conditions that may result in an improper or inconsistent operation of the dispensing gun. Thus, the user can address the condition in a timely manner and reduce the production of defective or scrap product.

According to the principles of the present invention and in accordance with the preferred embodiments, the invention provides an apparatus for detecting a high impedance load on an output of a driver circuit. The driver circuit has a power switching circuit providing output signals to a coil, wherein each output signal results from a drive signal that has a waveform comprising a higher magnitude initial peak period followed by a lower magnitude hold period. The apparatus includes a diagnostic circuit connected to the driver circuit. The diagnostic circuit provides a high impedance error signal in response to detecting, during only the higher magnitude initial peak period of the drive signal, a voltage of the output signal exceeding a predetermined value.

In another embodiment of the invention, the driver circuit has a feedback circuit providing a difference signal as a function of a difference between an output signal and a corresponding drive signal. The diagnostic circuit provides a high impedance error signal in response to detecting the difference signal crossing a threshold magnitude. In one aspect of this invention, the diagnostic circuit provides the high impedance error signal in response to detecting the difference signal crossing a threshold magnitude during the higher magnitude initial peak period of a drive signal.

In a further embodiment of the invention, a method is provided for detecting a high impedance load on an output of a gun driver circuit electrically connected to a coil of a fluid dispensing gun. The method first applies output signals to the coil in response to corresponding drive signals, each drive signal having a waveform comprising a higher magnitude initial peak period followed by a lower magnitude hold period. Next, a high impedance error signal is provided in response to detecting a magnitude of an output signal crossing a threshold magnitude.

In a still further embodiment of the invention, a difference signal is produced as a function of a difference between each of the output signals and a corresponding drive signal. The high impedance error signal is then provided in response to a sampled difference signal exceeding a threshold magnitude. In one aspect of these embodiments, the high impedance error signal is provided in response to detecting the difference signal crossing a threshold magnitude during the higher magnitude initial peak period of a drive signal.

These and other objects and advantages of the present invention will become more readily apparent during the following detailed description taken in conjunction with the drawings herein.

DETAILED DESCRIPTION OF THE INVENTION

Figure 1:
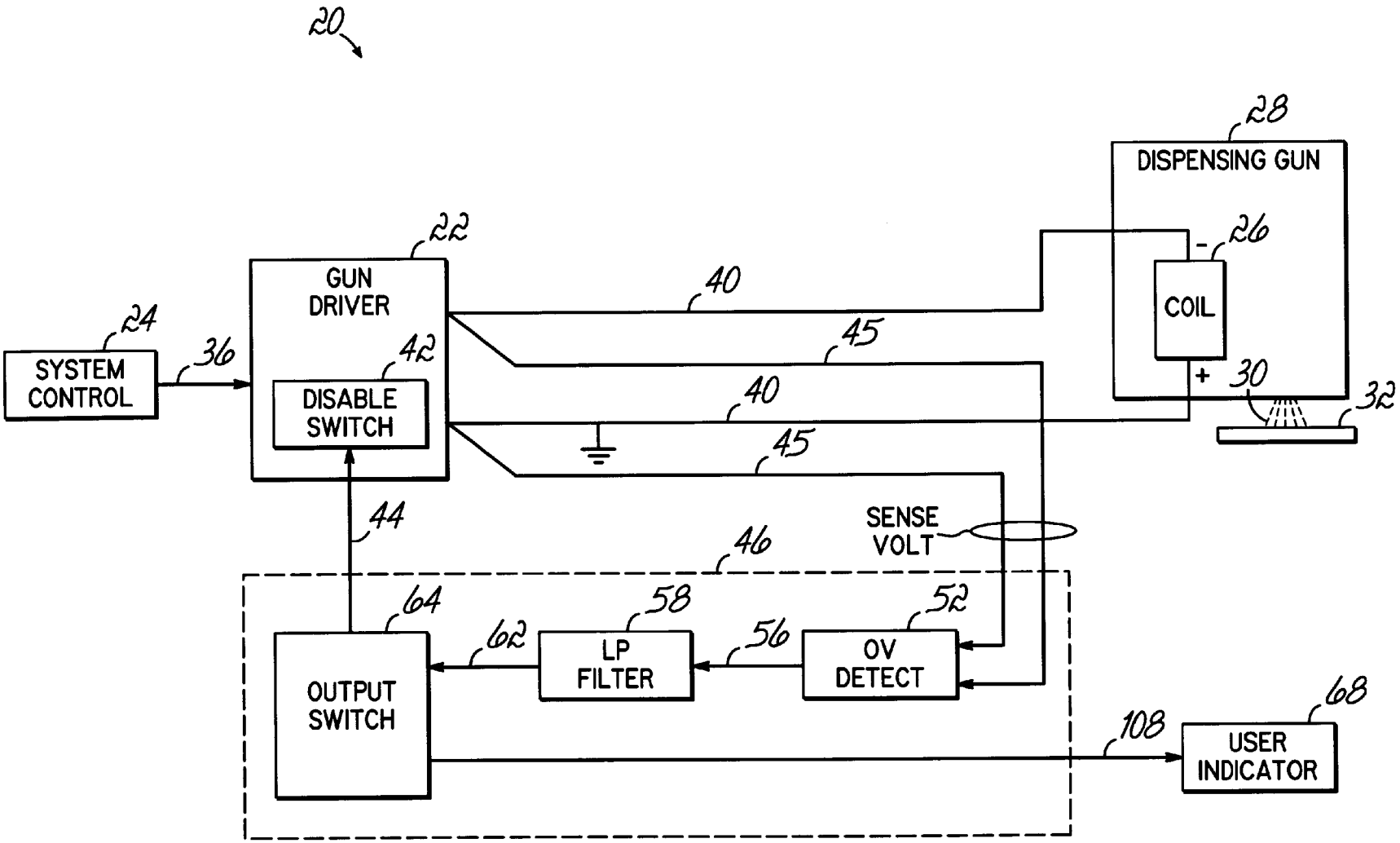
FIG. 1 is a schematic block diagram of a gun driver circuit for a fluid dispensing gun having a high impedance diagnostic in accordance with the principles of the present invention.

Referring to FIG. 1, a portion of a fluid dispensing system 20 is comprised of a gun controller or gun driver circuit 22 electrically connected to a system control 24 and a coil 26. The coil 26 may be the coil of a solenoid in a pneumatic dispensing gun or a gun coil in an electric dispensing gun. In either application, the coil 26 is used to operate the dispensing gun 28, thereby dispensing a fluid 30 onto a substrate 32. The driver circuit 22 is of a known design and normally comprises timing logic and a waveform generator that provides an input signal having a stepped waveform. The input signal is provided to a power switching circuit via an error amplifier. The power switching circuit is connected to a DC source and provides an output signal having a waveform corresponding to the input signal. A current sensor provides a feedback signal to the error amplifier. The system control 24 includes other known dispensing system or machine controls (not shown) necessary for the operation of the dispensing system 20, for example, a pattern control, and provides a trigger signal on an output 36. The system control 24 also includes input devices (not shown) such as a keypad, pushbuttons, etc. and output devices such as a display, indicator lights, a relay, etc., that provide communication links with a user in a known manner.

Figure 2:
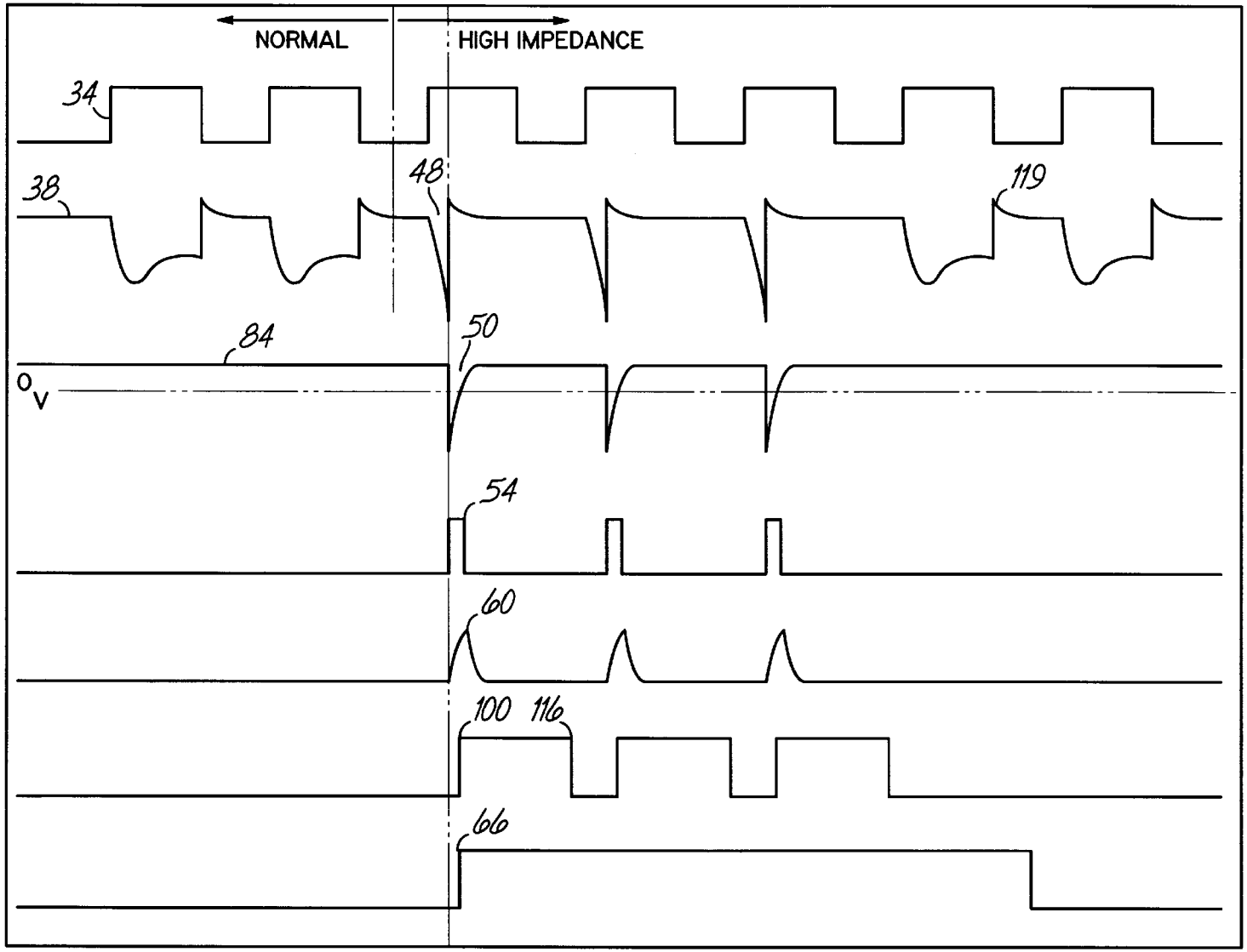
FIG. 2 illustrates waveforms of various signals provided by the gun driver and diagnostic circuit of FIG. 1.

The fluid dispensing system 20 is operated in response to a trigger pulse represented by a waveform 34 of FIG. 2 that is supplied on an output 36 from the system control 24. With each trigger pulse, the gun driver 22 provides an output signal represented by waveform 38. A diagnostic circuit 46 for performing high impedance diagnostic is electrically connected to the gun driver circuit 22. The diagnostic circuit 46 detects a high impedance error condition by sampling or monitoring each output signal waveform provided on the gun driver output 40 to the coil 26. Upon detecting an abnormally high output voltage, the diagnostic circuit 46 provides a signal on an output 44 to a disable switch 42; and the disable switch 42 terminates the output signal from the output 40 of the gun driver 24.

It should be noted that the gun driver 22 of the described embodiment operates as a controlled current source. Therefore, if during operation, the impedance of the output circuit of the coil 26 increases, the gun driver 22 increases the output voltage so that a controlled current is supplied to the coil. It is possible that the gun driver can increase the output voltage to a magnitude causing damage to either, the components within the gun driver or, the output circuit of the coil 26. Therefore, it is known to provide a protective circuit for the gun driver 22 to limit the magnitude of the output voltage that is provided in response to an abnormally high output circuit impedance. It should be noted that it is known to use a disable switch 42 to terminate the operation of the gun driver 42 upon detecting other error conditions.

The diagnostic circuit 46 comprises an over-voltage detector 52 that monitors each of the output signals on the output 40 of the gun driver 22. As shown in waveform 38, with normal output signals, the diagnostic circuit 46 is inactive. However, in the presence of a high impedance or open circuit condition, the gun driver 22 increases the voltage on its output 40 to a higher level as shown by the leading edge of the waveform 48. A known circuit within the gun driver senses the rapidly rising output voltage and provides a similar signal as indicated by the leading edge of the waveform 50 on an input 45 of the diagnostic circuit 46. The over-voltage detector 52 senses the excessive voltage magnitude signal and provides an output pulse 54 on the input 56 of a low pass filter 58. The low pass filter 58 provides a waveform 60 on an input 62 of an output switch 64. The output switch 64 provides a disable signal on an output 44 to a disable switch 42; and the disable switch 42 terminates the output signal from the output 40 of the gun driver 24 as shown by trailing edges of the waveforms 48, 50. The output switch 64 also provides a signal waveform 66 to a user indicator 68. The user indicator 62 may be an LED or other sensory perceptible display, a relay, etc. Thus, the diagnostic circuit performs two functions upon detecting an unacceptably high impedance in the coil 26. First, it provides a protective feature that disables the operation of the gun driver 22 in the presence of an over-voltage condition; and second, it warns the user of an over-voltage or high impedance condition.

Figure 3:
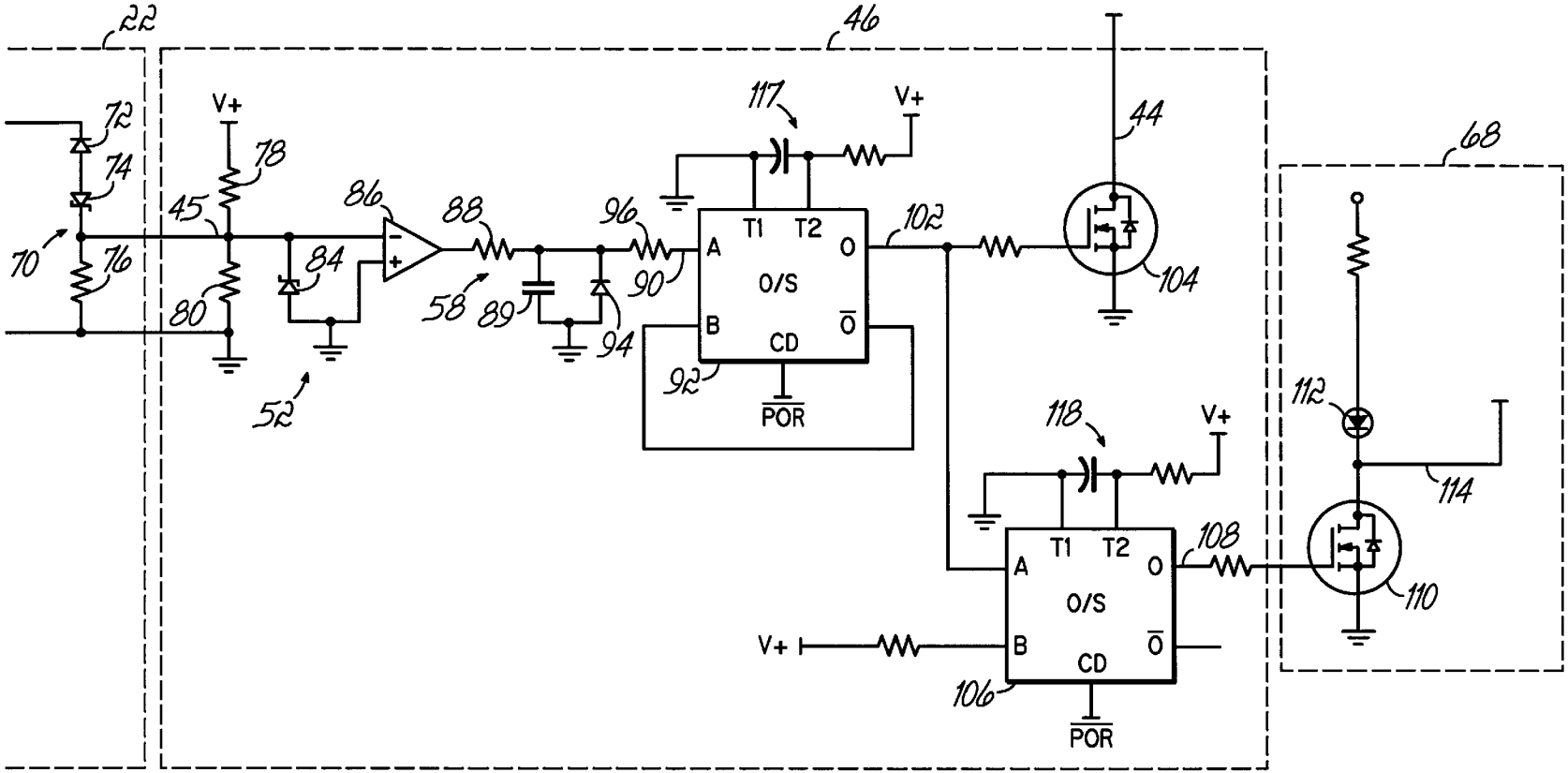
FIG. 3. is a detailed schematic diagram of one embodiment of the diagnostic circuit of FIG. 1.

Referring to FIG. 3, the diagnostic circuit 46 utilizes a known voltage sensing circuit 70 within an output section of the gun driver 22. The output sensing circuit 70 comprises a diode 72, a transient voltage suppressor ("TVS") 74, for example, a zener diode, and a resistor 76. The sensing circuit 70 provides a voltage signal over input 45 to the over-voltage detector 52 of the diagnostic circuit 46. Under normal output impedance conditions, the network of resistors 78, 80 bias the input 45 of the over-voltage detector 52 to a small positive voltage, for example, 0.25 volts as shown by the waveform 84. In this state, the TVS 74 is not conducting and the off current of diode 72 is very low. In the event that the impedance of the output circuit of the gun driver 22 goes very high or represents an open circuit, the output voltage of the power supply rises quickly and exceeds the breakdown voltage, for example, 400 volts, of the TVS 74 as represented by the leading edge of the waveform 48.

When current flows in the TVS 74, voltage is dropped across resistor 76; and the input 45 to the over-voltage detector 52 drops to a small negative voltage, for example, −0.4 volts. The diode 84 protects the input of the integrated circuit comparator 86. When the input 45 of the comparator 86 drops to the small negative voltage, the comparator 86 switches and provides an output pulse as shown by waveform 54. The resistor 88 and capacitor 89 operate as the low pass filter 58, and a waveform 60 is presented on an input 90 of a retry interval one-shot multivibrator 92. The diode 94 and resistors 96, 88 protect the input 90 of the one-shot multivibrator 92 from negative voltages.

The waveform 60 causes the one-shot multivibrator 92 to provide an output pulse as represented by waveform 100 on its output 102. That pulse immediately changes the state of, for example, closes, switch 104, thereby providing a disable signal on output 44 to the disable switch 42 of FIG. 1. The disable switch 42 disables the output 40 of the gun driver 22 for the on-time of the output from the retry interval one-shot multivibrator 92. In addition, the waveform 100 on the output 102 triggers a retry filter one-shot multivibrator 106 that provides a signal on its output 108 represented by the waveform 66. The one-shot multivibrator 106 functions as a filter that spans retry intervals from the one-shot multivibrator 92 in order to provide a continuous high impedance error indication. The positive or true state of the output 108 causes the switch 110 within the user indicator 68 to change state, for example, close. Closing switch 110 is operative to illuminate the LED 112 and provide an error signal over line 114 representing a high impedance condition. The switch 110 provides a buffering for the error signal representing a high impedance, and line 114 can be used to initiate a relay contact closure for remote signaling.

Not only does the diagnostic circuit 46 detect the presence of an unacceptably high impedance on the output of the gun driver 22, but it also detects the reestablishment of a normal output circuit impedance and terminates the error signal in response thereto. That feature is achieved by properly setting the lengths of the time intervals for the retry interval one-shot multivibrator 92 and the retry filter one-shot multivibrator 106. The timing period of the retry interval one-shot multivibrator 92 is asynchronous with the trigger signal. As can be seen from the waveforms 100 and 34, the timing period of the retry interval one-shot multivibrator 92 is less than the period of the trigger signal 34, for example, 20% less. After a first over-voltage condition at 48 is detected, the operation of the retry interval one-shot multivibrator 92 is effective to disable the gun driver 22 via the disable switch 42; and thereafter, the one-shot multivibrator 92 times out and switches state at 116. That, in turn, returns the switch 104 to its original or default open state, thereby returning the disable switch 42 to its default state and permitting the operation of the gun driver 22 to continue. The gun driver 22 is again operative to provide an output signal on output 40 in response to the next leading edge of the trigger signal. If an over-voltage is again detected during the next output signal, the retry one-shot multivibrator 92 is again operated as is the one-shot multivibrator 106; and the error signal representing a high impedance is continuously maintained on the output 114.

The RC network 117 determines the timing period of the retry interval one-shot multivibrator 92. The timing period of the retry filter one-shot multivibrator 106 is determined by the RC network 118 and is established to be slightly greater than twice the timing period of the retry one-shot multivibrator 92. Thus, the retry filter one-shot multivibrator maintains a true state on its output 108 for at least two full periods of operation of the retry one-shot multivibrator 92. If a subsequent trigger pulse results in the resumption of a normal waveform 119, the over-voltage condition on the output 40 on the gun driver 22 no longer exists; and the retry interval one-shot multivibrator 92 does not fire. The retry filter one-shot multivibrator 106 subsequently times out, and the signal on its output 108 returns to its default or false state. The switch 110 switches state, thereby turning off the LED 112 and terminating the error signal from the output 114.

Figure 4:
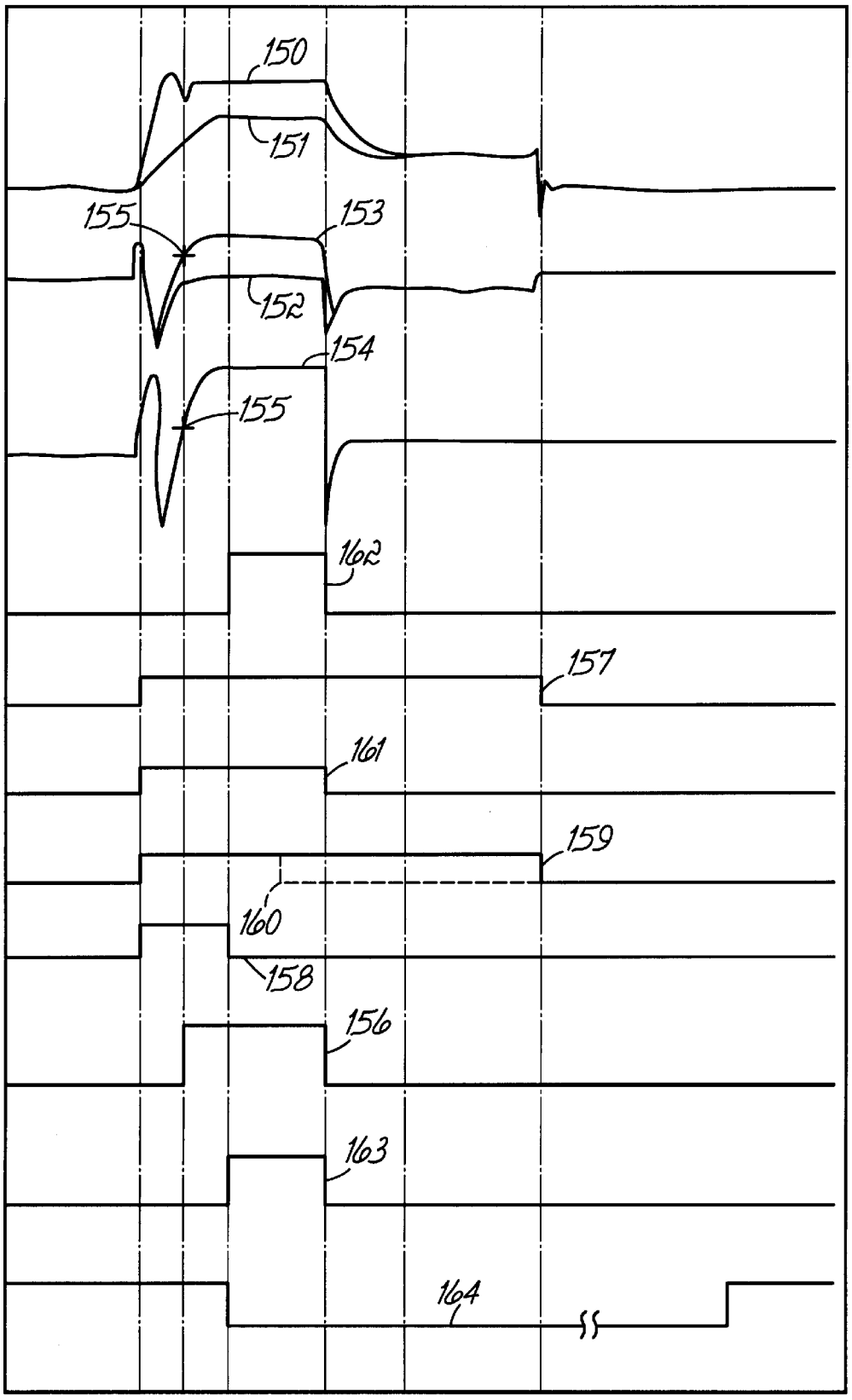
FIG. 4 illustrates waveforms of various signals provided by the gun driver and an alternative embodiment of a high impedance diagnostic circuit illustrated in FIG. 5.

The high impedance diagnostic of FIG. 3 detects a high impedance condition by sensing an overvoltage condition on the leading edge of the gun driver output signal. It is also feasible to detect a high impedance error condition by monitoring current rather than voltage. Referring to FIG. 4, as can be seen from the waveform 150, the initial portion of the peak current from the gun driver 22 experiences some instability prior to settling to a relatively constant magnitude. Consequently, it may be desired to monitor or sample the peak current during a more stable, latter portion of the peak current period.

Figure 5:
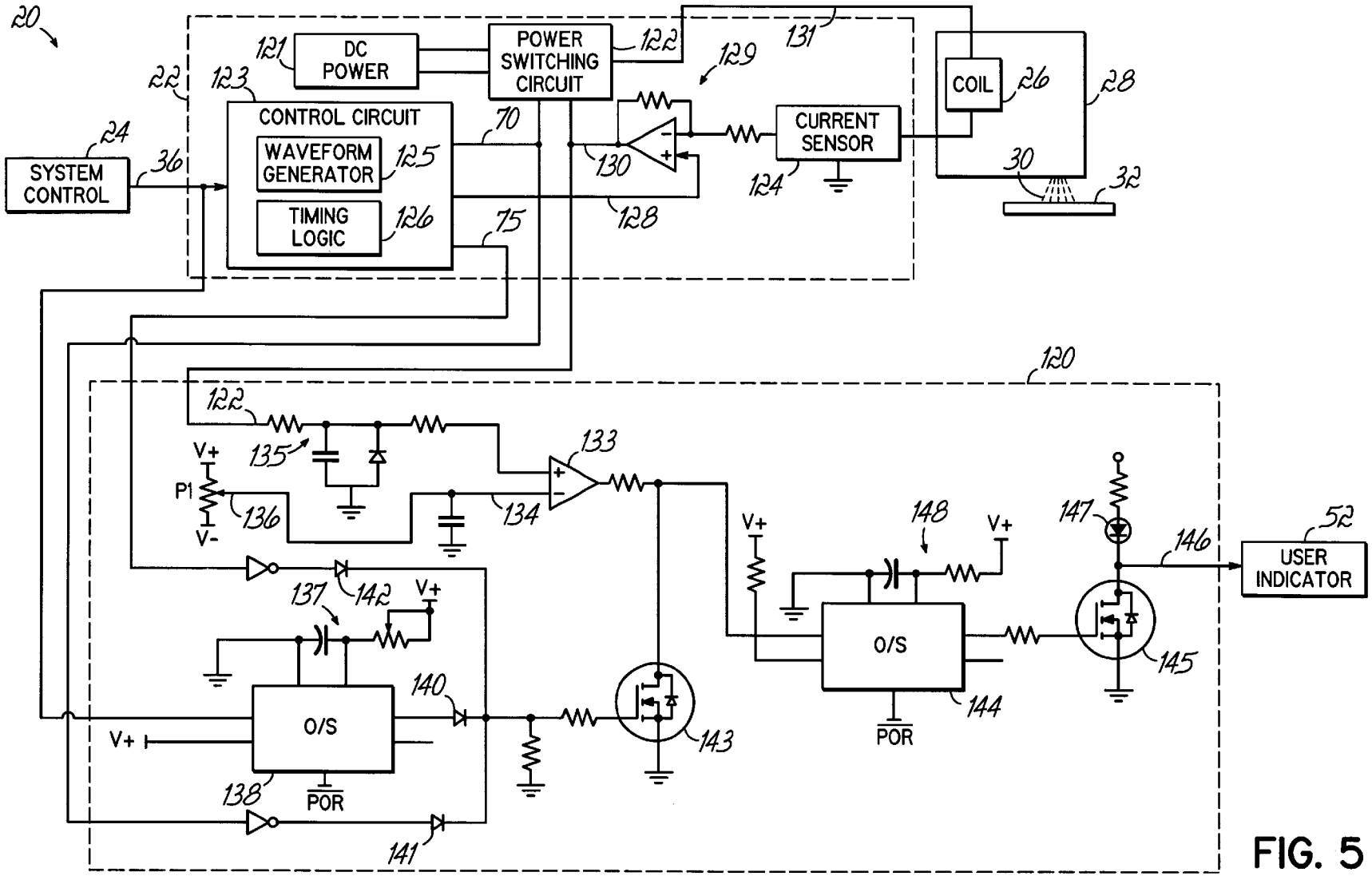
FIG. 5. is a detailed schematic diagram of an alternative embodiment of a high impedance diagnostic in accordance with the principles of the present invention.

An alternative embodiment of the high impedance diagnostic that delays the detecting of a high impedance load is schematically shown in FIG. 5. The system elements that are common to FIG. 1 have common numbers. The driver circuit 22 comprises a DC power source 121, power switching circuit 122, a control circuit 123 and a feedback circuit 127. The feedback circuit has a current sensor 124 and a feedback amplifier 129. The control circuit 123 normally has a waveform generator 125 and timing logic 126. The waveform generator 125 provides a drive signal to one input 128 of a feedback amplifier 129, and a difference signal on an output 130 of the feedback amplifier 129 is used to drive the power switching circuit 122. The power switching circuit 122 is connected to the source of DC power 121 that may be regulated or unregulated. The power switching circuit 122 is operated with a pulse width modulator or other known means (not shown) and applies an output signal to an output circuit 131 that includes a coil 24 and wires, connectors and other associated circuit elements not shown in detail. The output signal from the power switching circuit 122 also normally has a waveform corresponding to the desired waveform of the drive signal.

The current sensor 124 is electrically connected to the coil 26 and provides a feedback signal representing current in the coil 26. The current sensor 124 can be implemented with any one of many current measuring devices and methods, for example, a simple resistor, a Hall effect device, etc. The feedback amplifier 129 has a second input 132 connected to an output of the current sensor 124. Thus, the feedback amplifier 129 provides a difference signal on output 130 representing a difference between a desired waveform of the drive signal provided by the waveform generator 125 and a waveform of the feedback signal from the current sensor 124.

The fluid dispensing system 20 is operated in response to a trigger pulse represented by the waveform 157 of FIG. 4 that is supplied on a system control output 36. With each trigger pulse, the waveform generator 125 provides a drive signal having a stepped waveform, and that stepped waveform is reflected in the output signal as shown by the waveform 150 of FIG. 4. That generally stepped waveform is also found in the difference signal on the error amplifier output 130 that is represented by the waveform 152 of FIG. 4 and is fed back to the power switching circuit 122.

In the operation of a fluid dispensing gun, in order to achieve the highest actuation speed, a current pulse or spike is typically provided to the coil during an initial turn on period in order to initiate operation of the coil armature as quickly as possible. After the initial current pulse, the current through the coil is then reduced to approximately the minimum value required to hold the armature in its open position against the opposing force of a return spring. Such a stepped current waveform provides high performance while minimizing power dissipation in the coil. Thus, to open the dispensing gun, the output signal provides an initial current magnitude $I_{pk}$ for a duration or period of time $T_{pk}$ in response to a trigger pulse. Thereafter, the current is reduced to a lesser hold level $I_h$ for the remaining period of the on-time $T_{on}$. To close the dispensing gun, a lesser current value is then maintained for an off-time during the remaining time of the current waveform period. During the off-time, the current value may be substantially zero or some other value insufficient to operate the coil 26. The values of $I_{pk}$ and $T_{pk}$ are often chosen as a function of the application requirements, for example, the viscosity of the fluid being dispensed. Further, the value of the hold current $I_h$ is set to a nominal value equal to the minimum current required to hold the coil in the open position.

Initial values of magnitudes of the peak and hold currents are based on the coil specifications, however, the peak current magnitude $I_{pk}$, the magnitude of the hold current $I_h$ and the duration of the peak current $T_{pk}$ may be adjustable by the user. The user may adjust the current waveform and the dispensing line rate in order to tune the dispensing operation to its peak performance.

The embodiment of FIG. 5 is used to delay a detection of a high impedance condition that is represented by the gun current failing to achieve a target peak current setpoint. This can be indicative of several conditions, for example, a high impedance or open circuit, a poor impedance match between the gun and the driver, a peak time that is set too short, etc. A diagnostic circuit 120 for performing a high impedance diagnostic is electrically connected to the gun driver circuit 22. The diagnostic circuit 120 monitors the difference signal on the error amplifier output 130 of the feedback circuit 127 and detects a high impedance error condition by sampling or monitoring each output signal waveform provided by the power switching circuit 122 to the coil 26.

It has been observed that as the impedance of the output circuit 131 with the coil 26 increases above a matched impedance value with the driver circuit 22, the current through the coil 26 is reduced as shown by waveform 151 of FIG. 4. Further, the difference signal on output 130 from the feedback amplifier 129 experiences a detectable artifact that is not present when the output circuit impedance is reasonably matched to the driver circuit 22. For example, under a high impedance condition, the difference signal on the feedback amplifier output 130 deviates from its normal waveform 152 to a waveform 153 having an increased magnitude. If an open circuit condition exists, the difference signal on the feedback amplifier output 130 has an even greater magnitude as shown by the waveform 154. Thus, if the gun current is reduced by a high impedance condition, the high impedance condition can be detected by determining whether the difference signal crosses or exceeds a reference or threshold magnitude 155 of FIG. 4. Further, with the embodiment of FIG. 5, that detection is delayed from the peak current leading edge to a more stable portion of the peak current.

Referring to FIG. 5, within the high impedance detector 120, the difference signal from feedback amplifier output 130 first passes through a low pass filter 135. The filter cut off is determined by noise, the switching frequency of the driver, typical loads and other factors. The filtered difference signal is then input to a comparator 133 that has a second input 134 connected to a variable voltage source 136. The variable voltage source 136 provides a desired threshold or reference signal on the comparator input 134 that is represented by the magnitude 155 in waveforms 153, 154 of FIG. 4. The variable voltage source 136 may be implemented with a manual potentiometer, a digital-potentiometer, a programmable potentiometer, a digital-to-analog converter, etc. If the impedance of the output circuit 131 that includes the coil 26 rises above a desired matched impedance value, an artifact in the difference signal crosses the threshold value on input 134; and the comparator 133 switches state and provides an output signal as represented by the waveform 156 of FIG. 4.

A sampling holdoff or delay period is provided by a one-shot multivibrator 138 that is triggered by a leading edge of a trigger pulse on a system control output 36 that is represented by the waveform 157 of FIG. 4. An RC circuit 137 determines the length of the sampling holdoff or delay period. The RC circuit 137 includes a variable resistance source 139 that may be implemented with a manual potentiometer, a digital potentiometer, a programmable potentiometer, etc. Thus, the delay starts the difference signal sampling during a more stable portion of the peak duration. Different dispensing guns have substantially different inductance values, and therefore, the leading edge of the peak current pulse will take correspondingly different times to ramp up to the desired peak current value. The variable resistance source 139 can be set to match the inductance of a particular dispensing gun being used. Further, a programmed setting for the variable resistance source 139 can be stored with other stored specifications for a particular gun; and the desired voltage is automatically set upon the particular gun being identified to the system control 24. Alternatively, the desired resistance value can be manually entered or set by the user. As will be appreciated, in other embodiments, a variable voltage source may be used; or alternatively, a fixed resistor network may also be used.

The input to diode 141 is connected through an inverter and provides a switching signal over line 70 from the timing logic 126 within the control circuit 123. The switching signal is represented by the waveform 159 of FIG. 4 and controls when the gun driver 22 is turned off and the dispensing gun 25 is closed. That time is different depending on whether a bead application mode or a dot application mode is being used. When operating in a bead application mode, the trigger signal defines the duration of the output signal from the gun driver 22 and hence, the on-time of the dispensing gun. In the bead application mode, the on-time of the switching signal waveform 159 is the same as the trigger waveform 157. In a dot application mode, the leading edge of the trigger waveform 157 triggers the leading edge of the switching signal waveform 159. However, the timing logic within the control circuit 28 controls the trailing edge of the switching signal waveform 159. Thus, whether in the bead application mode or the dot application mode, a leading edge of the trigger signal initiates a waveform 150 to open the dispensing gun 25. However, in the dot application mode, the output signal 150 from the gun driver 22 is turned off and the dispensing gun 25 is closed by the trailing edge of the switching signal 159. Thus, as shown in phantom at 160, the trailing edge of switching signal 159 can vary as a function of the parameters of the dot application mode.

The input to diode 142 is connected through an inverter to an output 75 of the timing logic 33 that provides a peak current duration signal as generally represented by the waveform 161. When the timing period of the one-shot multivibrator 138 expires, the multivibrator 138 switches state taking the output to diode 140 low as represented by the waveform 158 of FIG. 4. When the one-shot multivibrator 138 expires, the outputs to diodes 141, 142 should also be low; and the switch 143 changes state, for example, to an open state as represented by the waveform 162. Opening the switch 143 presents the output signal from the comparator 133 as represented by the waveform 163 to the input of the one-shot multivibrator 144. The output signal triggers the one-shot multivibrator 144 that, in turn, operates the switch 110 within the user indicator 68. The switch 110 provides an error signal represented by the waveform 164 on output 114 representing a high impedance error condition. That error condition is also represented visually to the user by illuminating the LED 112.

At the end of the peak current duration, the peak current duration signal waveform 161 on line 75 changes state; and switch 143 changes state (waveform 162), thereby blocking further output signals from the comparator 133 (waveform 156) from firing the one-shot multivibrator 144. Thus, the diodes 140, 141, 142 and switch 143 are effective to provide a peak sample pulse as represented by waveform 162. At the end of the timing period of the one-shot multivibrator 144, as determined by the RC circuit 148, for example, 470 milliseconds, its output again changes state, which causes the switch 110 to return to its original state, thereby turning off the LED 112. The time period of the one-shot multivibrator 144 determines the frequency at which a high impedance condition can be indicated to the user. Thus, the time period of the one-shot multivibrator 144 is determined by several factors, for example, the desired responsiveness of the diagnostic circuit 120, the devices receiving the error signal, etc. The time period of the one-shot 144 often has a range of about 0.1–2 seconds.

If during a subsequent output signal from the gun driver 22, the difference signal on input 130 experiences another threshold crossing, the comparator 133 cycles again, thereby initiating the operation of the one-shot multivibrator 144 and the switch 110. Hence, a second error signal is provided on the output 114 thus illuminating the LED 112 for a second time.

Figure 6:
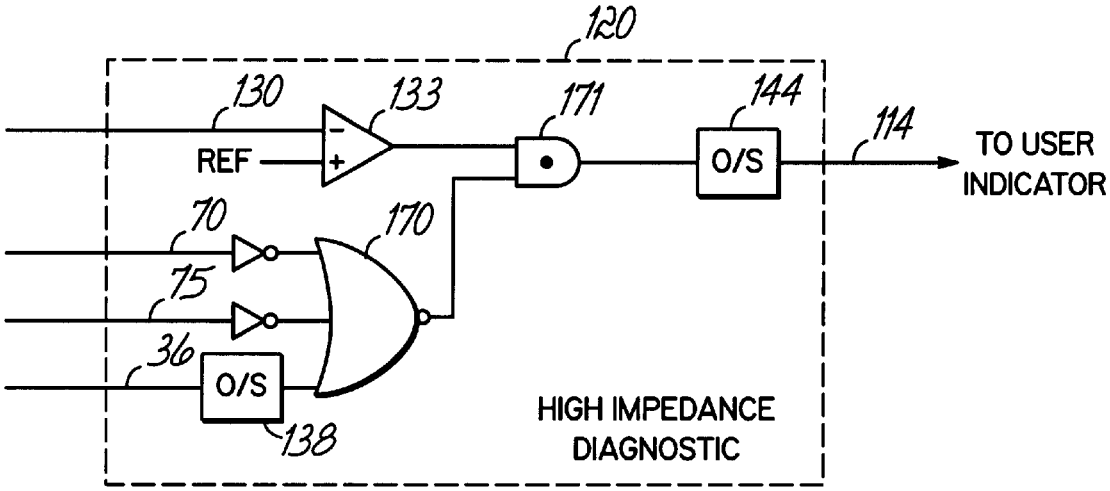
FIG. 6. is a logic flow diagram of the high impedance diagnostic circuit of FIG. 5.

An equivalent logic circuit for the diagnostic circuit 120 is illustrated in FIG. 6 in which a NOR gate 170 is used to create the peak sample pulse waveform 162. The NOR gate 170 is implemented with the diodes 140, 141 and 142 and switch 143 of FIG. 5. The AND gate 171 of FIG. 6 is implemented by the output of the switch 143 and the resistor on the output of the comparator 133 of FIG. 5.

In use, the diagnostic circuits 46, 120 are capable of detecting numerous high impedance conditions in the output circuit of the gun driver 22. For example, the output circuit of the gun driver 22 may be improperly wired; or the wires may be broken. Or, the output circuit of the gun driver 22 may have a loose and intermittent wiring connection; or a component such as the dispensing gun may not be electrically connected to the gun driver, either by an intentional or an inadvertent action. Any of those conditions will create a high impedance circuit or load on the output of the driver circuit 22. The diagnostic circuit 46 detects that high impedance load, and the gun driver 22 is temporarily disabled. In addition, both diagnostic circuits 46, 120 provide an error signal representing a high impedance to the user indicator 68. If, subsequently, the open wire or loose wiring connection are fixed, or the gun 25 is electrically reconnected to the driver circuit 22, the diagnostic circuits 46, 120 detect a normal output voltage and terminates the error signal to the user indicator 68.

Thus, when it is desired that the gun driver 22 operate in its normal or fluid dispensing mode of operation, the diagnostic circuits 46, 120 monitor that operation for high impedance signals that cause the fluid dispensing gun 25 to be inoperative. Absent such a error signal, the user would most probably not learn of the dispensing gun's failure until a defective or scrap product is detected. Thus, the diagnostic circuits 46, 120 are effective to provide the user with an immediate warning of a dispensing gun failure. Further, the user may utilize the diagnostic circuits 46, 120 to isolate the open circuit. For example, the user can quickly execute a checklist of highly probable faults causing an open circuit error by physically manipulating wires during the execution of the checklist. If there is an intermittent wire or loose connection, a physical manipulation of the wire or connection often results in an intermittent occurrence of the error signal, thereby causing the LED 112 to operate intermittently.

Thus, the diagnostic circuits 46, 120 have the advantage of substantially reducing the time required for a user to detect a disabling high impedance or open circuit condition. Further, the diagnostic circuits 46, 120 can often be used to substantially reduce the time required to diagnose the open circuit condition. Consequently, the diagnostic circuits 46, 120 are effective to substantially reduce defective and scrap product resulting from a high impedance or open circuit condition.

In addition, the diagnostic circuits 46, 120 are also capable of detecting a large impedance mismatch between the gun driver 22 and the coil 26. As indicated earlier, an impedance mismatch between the gun and the output of the driver circuit 22 can lead to an inconsistent fluid dispensing process. Therefore, with the present invention, a severe impedance mismatch between the gun driver 22 and the coil 26 can be detected. In that application, a separate diagnostic circuit can be used to test the impedance mismatch of the coil 26. Further, impedance mismatch of the coil 26 can be tested at any time. For example, such a circuit can be activated for a short period of time at the beginning of a dispensing cycle or at other times that a trigger pulse is being created.

While the present invention has been illustrated by a description of various embodiments and while these embodiments have been described in considerable detail in order to describe a mode of practicing the invention, it is not the intention of Applicant to restrict or in any way limit the scope of the appended claims to such detail. Additional advantages and modifications within the spirit and scope of the invention will readily appear to those skilled in the art. For example, in the described embodiment, the diagnostic circuit 46 is effective to protect the gun driver 22 by operating the disable switch 42 as well as provide an error signal representing a high impedance to the user via output 114. As will be appreciated, some other circuit may operate the disable switch 42. Further, the over-voltage detector 52 is implemented with a TVS 74 and other circuitry. As will be appreciated, the over-voltage detector may be implemented with a resistive divider and a comparator. In addition, the low pass filter 58 is described as being on the output side of the comparator 86; however, as will be appreciated, alternatively, the low pass filter 58 may be located on the input side of the comparator 86.

Further, the described embodiment is effective to detect the state of the difference signal during the initial peak current duration. As will be appreciated, alternatively, the comparator 54 can also be used to detect high impedance conditions during the hold current duration. The reference threshold on input 134 can be set to optimize the detection of a high impedance condition during the hold current duration. Further, the one-shot multivibrator 138 can be used to delay the sampling of the oscillation in the output signal until a stable portion of the hold current period. However, as will be appreciated, the lower magnitude of the hold current presents a signal to the comparator 133 that is closer in magnitude to the threshold value. Therefore, there is the possibility that the occurrence of noise or other irregularities during the hold current duration could cross the threshold and be detected as an error signal by the comparator 133.

Further, the impedance monitoring system of the present invention monitors the impedance with each operation of the dispensing gun. As will be appreciated, the impedance monitoring function can be implemented to operate intermittently. A timer can be used to turn the high impedance diagnostic circuit on and off as desired or as is appropriate with a particular application.

Therefore, the invention in its broadest aspects is not limited to the specific details shown and described. Consequently, departures may be made from the details described herein without departing from the spirit and scope of the claims that follow.

What is claimed is:

1. An apparatus for use with a fluid dispensing gun having a driver circuit with a load connected thereto, the driver circuit having a power switching circuit providing output signals to a gun coil in the load, each output signal occurring in response to a drive signal having a waveform comprising a higher magnitude initial peak period followed by a lower magnitude hold period, the apparatus comprising:

a diagnostic circuit connected to the driver circuit, said diagnostic circuit providing a high impedance error signal in response to detecting during only the higher magnitude initial peak period of the drive signal, a voltage of the output signal exceeding a predetermined value, the high impedance error signal representing a high impedance of the load.

2. The apparatus of claim 1 wherein said diagnostic circuit further comprises:

a comparator responsive to one of the output signals and a reference signal for providing said high impedance error signal in response to detecting the one of the output signals crossing a magnitude of the reference signal.

3. The apparatus of claim 2 wherein said diagnostic circuit further comprises:

a switch responsive to said high impedance error signal for terminating an application of the output signals to the gun coil in response to said comparator producing said high impedance error signal.

4. An apparatus for detecting a high impedance of a load connected to a driver circuit of a fluid dispensing gun, the driver circuit having a power switching circuit providing output signals to a gun coil in the load, each output signal resulting from a drive signal that has a waveform comprising a higher magnitude initial peak period followed by a lower magnitude hold period, the driver circuit further having a feedback circuit providing a difference signal as a function of a difference between an output signal and a corresponding drive signal, the apparatus comprising:

a source of a reference signal; and a diagnostic circuit connected to the driver circuit, said diagnostic circuit providing a high impedance error signal in response to detecting the difference signal crossing a magnitude represented by said reference signal, the high impedance error signal representing a high impedance of the load.

5. The apparatus of claim 4 wherein said source provides an adjustable magnitude of said reference signal.

6. The apparatus of claim 4 wherein said diagnostic circuit further comprises:

a comparator responsive to the difference signal and said reference signal;

a first circuit electrically connected to the driver circuit for providing a gating signal representing a higher magnitude initial peak period of a drive signal; and a second circuit electrically connected to said comparator and said first circuit for providing said high impedance error signal during only the higher magnitude initial peak period of the drive signal.

7. The apparatus of claim 6 wherein said gating signal provided by said first circuit represents a stable portion of a higher magnitude initial peak period of a drive signal, and said second circuit produces said high impedance error signal during only the stable portion of the higher magnitude initial peak period of the drive signal.

8. The apparatus of claim 7 wherein said first circuit further comprises a one-shot multivibrator having an input triggered in response to a leading edge of the higher magnitude initial peak period of a drive signal, said one-shot multivibrator provides a delay of a leading edge of said gating signal until the stable portion of the higher magnitude initial peak period of the drive signal.

9. The apparatus of claim 8 wherein said delay provided by said one-shot multivibrator is adjustable.

10. The apparatus of claim 4 wherein said diagnostic circuit further comprises:

a first circuit electrically connected to the driver circuit for providing a gating signal representing a lower magnitude hold period of the drive signal; and a second circuit electrically connected to said comparator and said first circuit for producing said high impedance error signal during only the lower magnitude hold period of the drive signal.

11. The apparatus of claim 10 wherein said first circuit further comprises a one-shot multivibrator having an input triggered in response to a leading edge of a lower magnitude hold period of a drive signal, said one-shot multivibrator delaying a leading edge of said gating signal until the stable portion of the lower magnitude hold period of the drive signal.

12. An apparatus for detecting a high impedance of a load connected to a driver circuit of a fluid dispensing gun, the driver circuit having a power switching circuit providing output signals to a gun coil in the load, each output signal resulting from a drive signal that has a waveform comprising a higher magnitude initial peak period followed by a lower magnitude hold period, the driver circuit further having a feedback circuit providing a difference signal as a function of a difference between an output signal and a corresponding drive signal, the apparatus comprising:

a source of a reference signal; and a diagnostic circuit connected to the driver circuit, said diagnostic circuit providing a high impedance error signal in response to detecting the difference signal crossing a magnitude represented by said reference signal during a stable portion of the higher magnitude initial peak period, the high impedance error signal representing a high impedance of the load.

13. An apparatus for detecting a high impedance of a load in an output circuit that includes a coil of a fluid dispensing gun, the apparatus comprising:

a driver circuit adapted to be electrically connected to the output circuit, the driver circuit providing an output signal resulting from a drive signal having a waveform comprising a higher magnitude initial peak period followed by a lower magnitude hold period; said driver circuit having a switch for terminating the output signal; and a diagnostic circuit connected to said driver circuit, said diagnostic circuit providing a high impedance error signal to said switch in response to a voltage of said output signal exceeding a threshold magnitude.

14. An apparatus for detecting a high impedance of a load in an output circuit that includes a coil of a fluid dispensing gun, the apparatus comprising:

a driver circuit adapted to be electrically connected to the output circuit, the driver circuit providing an output signal resulting from a drive signal having a waveform comprising a higher magnitude initial peak period followed by a lower magnitude hold period; said driver circuit comprising a detector connected to the output circuit for detecting a feedback signal through the coil in response to said output signal, and an error amplifier connected to said detector and providing a difference signal as a function of a difference between said output signal and said drive signal; and a diagnostic circuit connected to said driver circuit, said diagnostic circuit providing a high impedance error signal in response to said difference signal exceeding a threshold magnitude.

15. The apparatus of claim 14 wherein said diagnostic circuit further comprises:

a comparator responsive to said difference signal and a reference signal for providing said high impedance error signal in response to detecting said output signal exceeding said threshold magnitude;

a first circuit electrically connected to said driver circuit for providing a gating signal representing a higher magnitude initial peak period of said drive signal; and a second circuit electrically connected to said comparator and said first circuit for producing said high impedance error signal in response to said difference signal exceeding said threshold magnitude during only the higher magnitude initial peak period of said drive signal.

16. The apparatus of claim 15 wherein said gating signal provided by said first circuit represents a stable portion of a higher magnitude initial peak period of a drive signal, and said second circuit produces said high impedance error signal during only the stable portion of the higher magnitude initial peak period of the drive signal.

17. A method of detecting a high impedance of a load having a coil on an output of a driver circuit of a fluid dispensing gun, the method comprising:

providing a drive signal having a waveform comprising a higher magnitude initial peak period followed by a lower magnitude hold period;

applying an output signal to the coil in response to the drive signal; and providing a high impedance error signal in response to detecting a voltage magnitude of the output signal crossing a threshold magnitude.

18. The method of claim 17 further comprising terminating the output signal in response to detecting the high impedance error signal.

19. A method of detecting a high impedance of a load having a coil on an output of a driver circuit of a fluid dispensing gun, the method comprising:

providing a drive signal having a waveform comprising a higher magnitude initial peak period followed by a lower magnitude hold period;

applying an output signal to the coil in response to the drive signal, producing a difference signal as a function of a difference between the output signal and the drive signal; and providing a high impedance error signal in response to a sample of the difference signal exceeding a threshold magnitude.

20. The method of claim 19 further comprising sampling the difference signal during a higher magnitude initial peak period of the drive signal; and providing the high impedance error signal in response to detecting a magnitude of a sampled difference signal crossing a threshold magnitude.

21. The method of claim 20 further comprising adjusting the threshold magnitude.

22. The method of claim 20 further comprising delaying sampling the difference signal until a stable portion of the higher magnitude initial peak period of the drive signal.

23. The method of claim 20 further comprising delaying sampling the difference signal for a predetermined period of time after a leading edge of the higher magnitude initial peak period.

24. The method of claim 19 further comprising sampling the difference signal during the lower magnitude hold period of the drive signal; and providing the high impedance error signal in response to detecting a magnitude of a sampled difference signal crossing a threshold magnitude.

25. The method of claim 24 further comprising delaying sampling the difference signal until a stable portion of the lower magnitude hold period of the drive signal.

* * * * *